US007408430B2

(12) United States Patent
Mikami

(10) Patent No.: US 7,408,430 B2
(45) Date of Patent: Aug. 5, 2008

(54) HIGH-FREQUENCY CIRCUIT DEVICE AND TRANSMITTING AND RECEIVING APPARATUS

(75) Inventor: Shigeyuki Mikami, Sagamihara (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 174 days.

(21) Appl. No.: 10/588,282

(22) PCT Filed: Apr. 20, 2005

(86) PCT No.: PCT/JP2005/007497

§ 371 (c)(1),
(2), (4) Date: Aug. 4, 2006

(87) PCT Pub. No.: WO2006/003747

PCT Pub. Date: Jan. 12, 2006

(65) Prior Publication Data

US 2007/0126532 A1 Jun. 7, 2007

(30) Foreign Application Priority Data

Jun. 30, 2004 (JP) ..... 2004-194478

(51) Int. Cl.
*H01P 1/203* (2006.01)

(52) U.S. Cl. ..... 333/204

(58) Field of Classification Search ..... 333/202, 333/204, 219

See application file for complete search history.

(56) References Cited

U.S. PATENT DOCUMENTS 6,023,209 A 2/2000 Faulkner et al.
6,700,459 B2 * 3/2004 Raihn et al. ..... 333/99 S
6,891,452 B2 * 5/2005 Mikami et al. ..... 333/219

FOREIGN PATENT DOCUMENTS

JP 6-112701 4/1994

(Continued)

OTHER PUBLICATIONS

By Kuang-Ping Ma, Fei-Ran Yang, Yongxi Qian and Tatsuo Itoh; "Nonleaky Conductor-Backed CPW Using a Novel 2-D PBG Lattice," (University of California, Los Angeles Electrical Engineering Department—1998 Asia-Pacific Microwave Conference WE2B-5).

(Continued)

*Primary Examiner*—Seungsook Ham
(74) *Attorney, Agent, or Firm*—Dickstein Shapiro LLP

(57) ABSTRACT

An undesired-wave propagation blocking circuit that blocks an undesired wave propagating between at least two parallel planar conductors is formed by a band eliminate filter including a plurality of stages of resonators and transmission lines each connecting the resonators in the respective stages. Each of the resonators in the respective stages has two spiral lines that extend in parallel to each other from each root portion, and leading ends of the spiral lines are connected to each other. Each root portion of the two spiral lines of the resonators is connected to a plurality of positions of the two transmission lines, and each of the resonators is short-circuited at one of respective short-circuit portions, which is a root portion.

4 Claims, 12 Drawing Sheets

FOREIGN PATENT DOCUMENTS

| | | |
|---|---|---|
| JP | 2000-101301 | 4/2000 |
| JP | 2000-349503 | 12/2000 |
| JP | 2001-308608 | 11/2001 |
| JP | 2003-258504 | 9/2003 |

OTHER PUBLICATIONS

International Search Report from corresponding International Application—Aug. 2, 2005.

Written Opinion from corresponding International Application—dated Aug. 2, 2005.

* cited by examiner (A)

(B)

| | UNIT LATTICE PATTERN | RATIO OF UNIT LATTICE LENGTHS | UNIT LATTICE LENGTH (mm) DESIGN EXAMPLE @30 GHz |
|---|---|---|---|
| (A) |  | 0.09 | 0.1 |
| (B) |  | 0.34～0.45 | 0.38～0.51 |
| (C) |  | 1 | 1.12 |

(A)

(B)

HIGH-FREQUENCY CIRCUIT DEVICE AND TRANSMITTING AND RECEIVING APPARATUS

CROSS REFERENCE TO RELATED APPLICATIONS

The present application is a national stage of PCT/JP2005/007497, filed Apr. 20, 2005, which claims priority to Japanese application No. 2004-194478, filed Jun. 30, 2004.

FIELD OF THE INVENTION

The present invention relates to a high-frequency circuit device, such as a waveguide or a resonator, including two parallel planar conductors and to a transmitting and receiving apparatus including the high-frequency circuit device.

BACKGROUND OF THE INVENTION

Various transmission lines, such as a grounded coplanar line in which a ground electrode is disposed substantially all over one surface of a dielectric plate and a coplanar line is disposed on the other surface of the dielectric plate, a grounded slot line in which a ground electrode is disposed on one surface of a dielectric plate and a slot is arranged in the other surface of the dielectric plate, and a planar dielectric transmission line (PDTL) in which slots facing each other across a dielectric plate are arranged in both surfaces of the dielectric plate, are used as transmission lines for a microwave band or a millimeter-wave band.

Each of such transmission lines includes two parallel planar conductors. Thus, for example, if an electromagnetic field is disturbed in an input/output portion or a bend of a line, there is a problem that a wave in a spurious mode, such as a so-called parallel-plate mode, is induced between the two parallel planar conductors (between the parallel planer conductors) and such a wave in the spurious mode (hereinafter, simply referred to as an "undesired wave") propagates between the planar conductors. The occurrence of such propagation (leakage) of an undesired wave causes a problem in that interference by the undesired wave is generated between adjoining lines and such interference causes leakage of a signal. In addition, since part of energy of a transmission wave is leaked as an undesired wave and is not reconverted into a transmission wave, transmission loss is generated.

In order to prevent such propagation of an undesired wave, a technology for alternately connecting inductor portions and capacitor portions and arranging the inductor portions and the capacitor portions on a two-dimensional plane is disclosed in "Nonleaky Conductor-Backed CPW Using A Novel 2-D PBG Lattice", 1998 APMC (non-patent document 1). In addition, a technology in which, as shown in FIG. 13A, a plurality of through holes 11 for allowing conduction between parallel planar conductors is arranged in a dielectric substrate forming a waveguide including the two parallel planar conductors and a technology in which, as shown in FIG. 13B, for example, an undesired-wave propagation blocking circuit 12 is disposed at a planar conductor on a front surface side of a dielectric substrate using conductor patterns comprising electrodes for generating capacitances between the electrodes and a planar conductor on a rear surface side and a plurality of lines that is connected to the electrodes and that forms inductors are disclosed in Japanese Unexamined Patent Application Publication No. 2000-101301 (patent document 1). In FIGS. 13A and B, the mark "x" represents a signal propagation direction of a slot line, and wavy lines represent states of propagation of undesired waves.

In addition, as the above-mentioned undesired-wave propagation blocking circuit, as shown in FIGS. 14A and B, a technology for arranging spiral parallel line resonators is disclosed in Japanese Unexamined Patent Application Publication No. 2003-258504 (patent document 2).

FIG. 14B is a partial plan view of a high-frequency circuit device including an undesired-wave propagation blocking circuit, and FIG. 14A is a partial plan view of the undesired-wave propagation blocking circuit. Planar conductors 2 are provided on the upper and lower surfaces of a dielectric substrate 1. Undesired-wave propagation blocking circuits 4 are disposed at the planar conductors 2. As shown in FIG. 14A, each of the undesired-wave propagation blocking circuits 4 includes two parallel transmission lines, transmission lines 7A and 7B, and resonators 8 are connected to the transmission line 7A. Each of the resonators 8 has two spiral lines, spiral lines 8A and 8B, that extend in parallel to each other from a root portion of the resonator 8, and leading ends of the spiral lines 8A and 8B are connected to each other at a point represented by 8C. The arrows E in the figures represent electric field vectors generated between two transmission lines.

The undesired-wave propagation blocking circuit 4 is formed by arranging a plurality of such pairs of transmission lines and resonators, as shown in FIG. 14B.

However, the structure including the through holes needs increased manpower for through-hole processing. Thus, the cost increases. In addition, in the structures in non-patent document 1 and patent document 1, since the undesired-wave propagation blocking circuits are large in size, the wafer size increases, and thus the cost increases. Moreover, the structure in patent document 2 has a problem in that an effective bandwidth in which propagation of an undesired wave is blocked is relatively narrow.

SUMMARY OF THE INVENTION

Accordingly, an object of the present invention is to provide a high-frequency circuit device that achieves miniaturization while blocking propagation of an undesired wave and that ensures a wide undesired-wave propagation blocking band, and a transmitting and receiving apparatus including such a high-frequency circuit device.

A high-frequency circuit device according to the present invention includes at least two parallel planar conductors and an undesired-wave propagation blocking circuit that is coupled with an undesired wave propagating between the two planar conductors to block the propagation of the undesired wave. The undesired-wave propagation blocking circuit forms a band eliminate filter including a plurality of stages of resonators and transmission lines each connecting the resonators in the respective stages. The transmission lines are two transmission lines that are in parallel to each other. Each resonator in the respective stages has two spiral lines extending in parallel to each other from each root portion of the two spiral lines of the resonator. Leading ends of the two spiral lines are connected to each other. Each root portion of the two spiral lines of the resonators is connected to a plurality of positions of at least one of the two transmission lines, each resonator is short-circuited at the root portions of the two spiral lines. each resonator is short-circuited at the root portions of the two spiral lines.

In addition, the high-frequency circuit device according to the present invention is configured such that the plurality of resonators is connected to the corresponding transmission lines ideally at an interval of $(2n+1)/4$ (n is an integer of 0 or more) of the wavelength of the transmission lines.

In addition, a transmitting and receiving apparatus according to the present invention is configured such that the high-frequency circuit device is provided in a signal propagation section or a signal processing section.

(1) According to the present invention, since a resonator including two spiral lines is provided in a midway position of at least one of two transmission lines, the area of a conductor pattern can be reduced as in the undesired-wave propagation blocking circuit described in patent document 2, and the entire miniaturization can thus be achieved. Moreover, since the root portions of the two spiral lines of the resonator are short-circuited, a bandwidth in which propagation of an undesired wave is blocked can be increased.

In addition, according to the present invention, since resonators are connected to the transmission lines at an interval of ideally (2n+1)/4 (n is an integer of 0 or more) of the wavelength of the transmission lines, an operation as a band eliminate filter that attenuates in a predetermined band in which a resonant frequency of each resonator serves as an intermediate frequency can be effectively achieved. Thus, propagation of an undesired wave in a predetermined frequency band can be effectively suppressed.

In addition, according to the present invention, since a transmitting and receiving apparatus includes the high-frequency circuit device described above, an undesired-wave propagation blocking circuit can be provided on a dielectric substrate of the transmitting and receiving apparatus, thus enabling the blocking of an undesired wave propagating on the dielectric substrate. Thus, high efficiency can be achieved by reducing power loss due to an undesired wave, and noise due to an undesired wave can be reduced. In addition, since interference between lines or between a line and an element can be reliably prevented even if the space between the lines or the space between the element and the line is reduced in a case where the plurality of lines is disposed on the dielectric substrate or in a case where the line is disposed together with the element, such as a resonator, a transmitting and receiving apparatus whose entire size is reduced can be achieved.

REFERENCE NUMERALS

1—dielectric substrate
2—planar conductor
3—slot
4—undesired-wave propagation blocking circuit
5—shield member
7A, 7B—transmission line
8A, 8B, 8C—spiral line
9A, 9B, 9C—spiral line
8S, 9S—short-circuit portion
8, 9—resonator
SA, SB—midway position of line
SL—phase shifter
LU—unit lattice

DETAILED DESCRIPTION OF THE INVENTION

A high-frequency circuit device according to a first embodiment will be described with reference to FIGS. 1 to 7.

Figure 4:
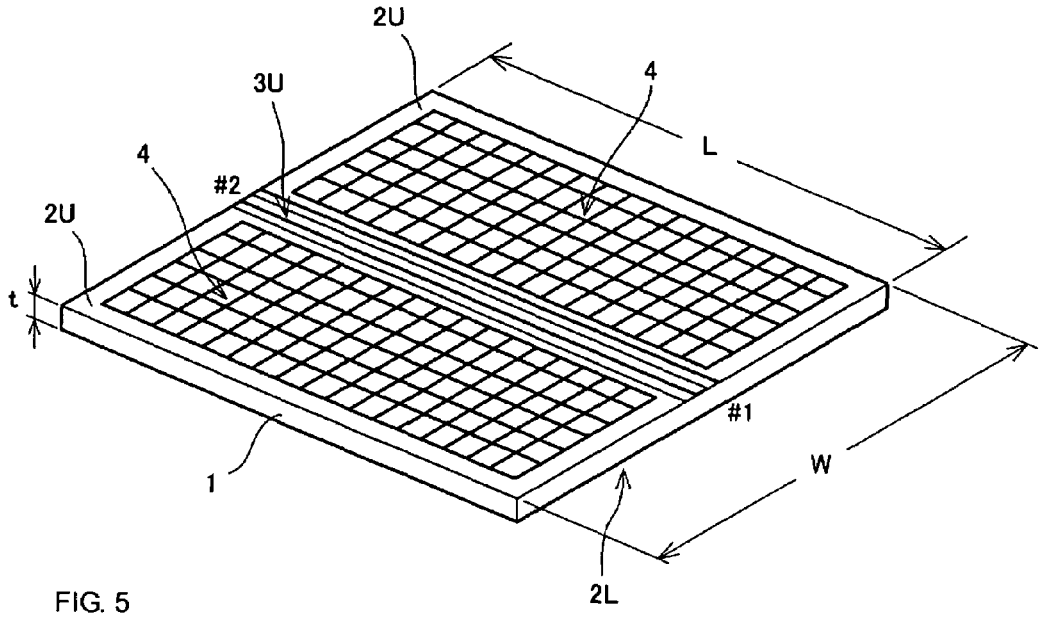
FIG. 4 is a perspective view showing the structure of a main portion of a high-frequency circuit device.
Figure 5:
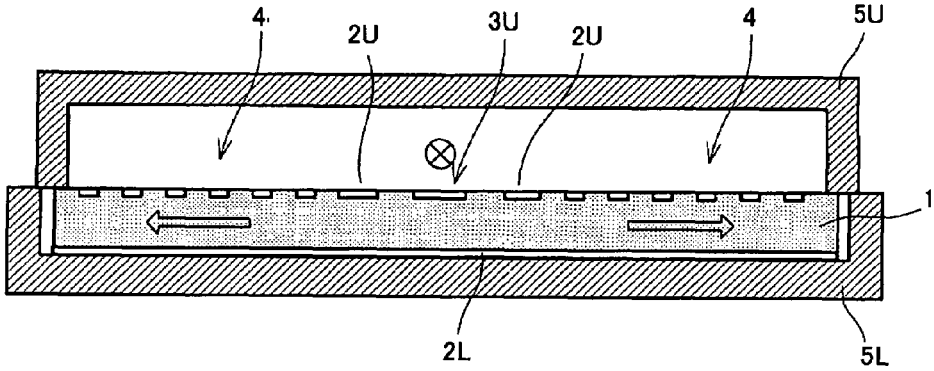
FIG. 5 is a cross-sectional view of the high-frequency circuit device.
Figure 6:
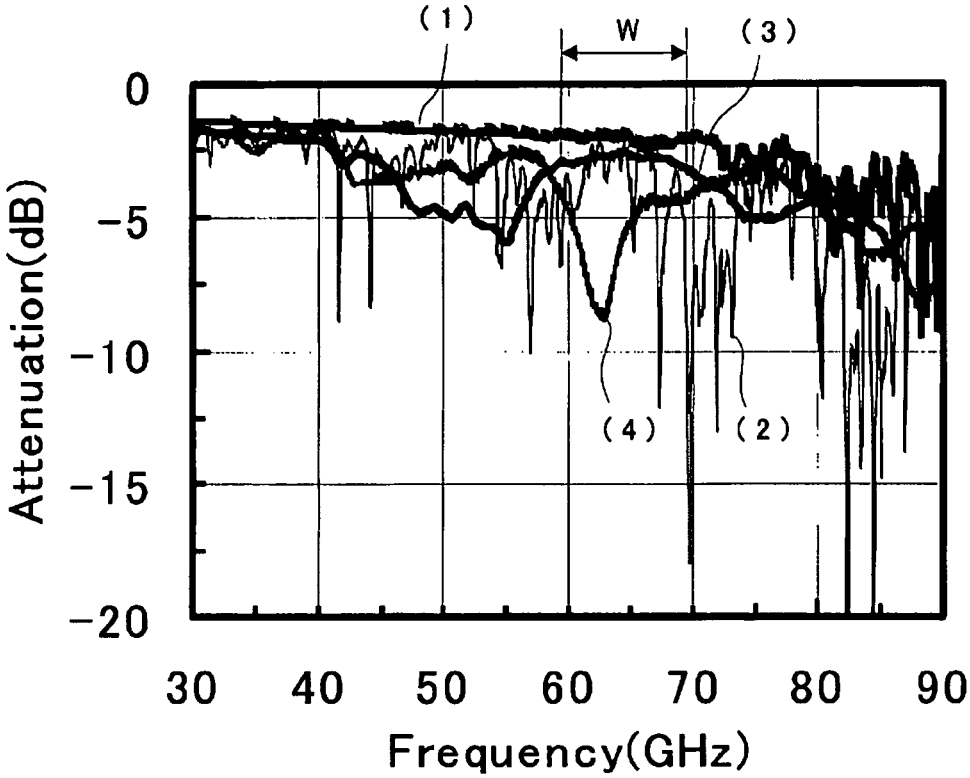
FIGS. 6A and B are characteristic diagrams of the high-frequency circuit device.
Figure 6:
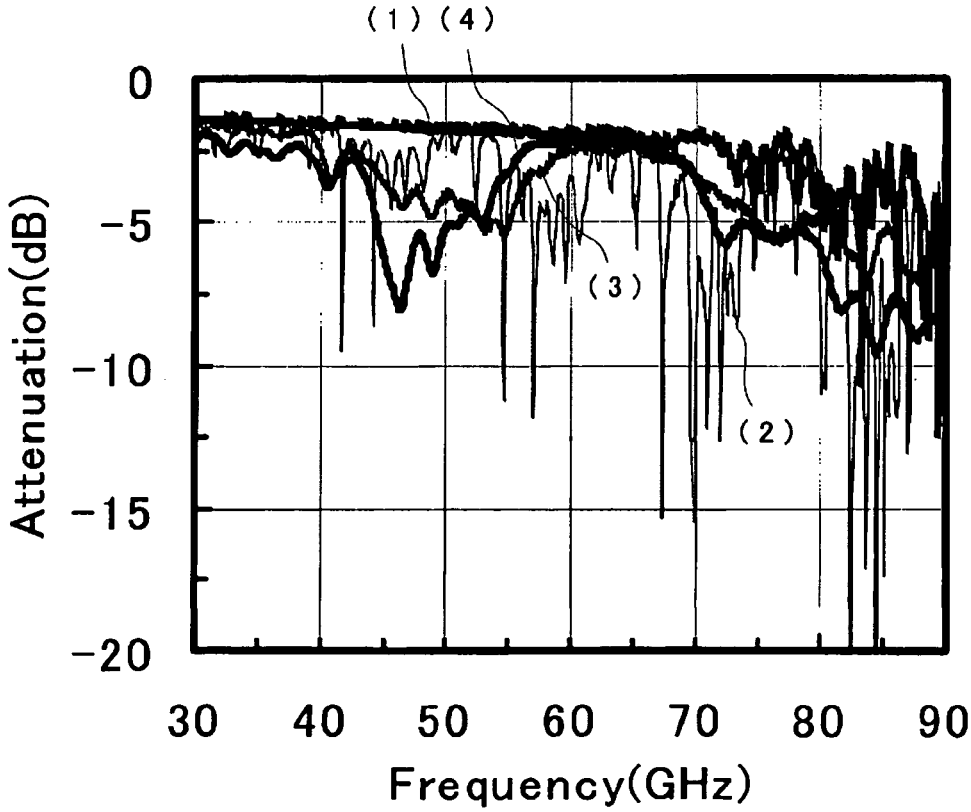

FIG. 4 is an external perspective view of a main portion of the high-frequency circuit device including an undesired-wave propagation blocking circuit. FIG. 5 is a cross-sectional view of the main portion of the high-frequency circuit device. As shown in FIGS. 4 and 5, planar conductors 2U and 2L are disposed on the upper and lower surfaces of a dielectric substrate 1, respectively. A central conductor (hot line) 3U is disposed on the upper surface of the dielectric substrate 1. Shield members 5U and 5L are provided over the upper surface and under the lower surface of the dielectric substrate 1, respectively. The dielectric substrate 1, the planar conductors 2U and 2L disposed on the upper and lower surfaces of the dielectric substrate 1, respectively, the central conductor 3U, and the shield members 5U and 5L form a grounded coplanar line (hereinafter, referred to as a "CBCPW").

An undesired wave in a parallel-plate mode or the like propagates between the two planar conductors, the planar conductors 2U and 2L, which are parallel to each other. Thus, an undesired-wave propagation blocking circuit 4 is disposed in an area covering both sides across the central conductor 3U on the upper surface of the dielectric substrate 1 by patterning the planar conductor 2U. The undesired-wave propagation blocking circuit 4 includes resonators disposed in a plurality of positions of two transmission lines, as described below. The undesired-wave propagation blocking circuit 4 is formed by arranging the resonators such that a predetermined area of a dielectric substrate is filled with the resonators.

Not only propagation of an undesired wave between the parallel planar conductors 2U and 2L is blocked by coupling the propagating undesired wave with the undesired-wave propagation blocking circuit 4, but propagation of an undesired wave in a space between the upper planar conductor 2U and an inner surface of the upper shield member 5U is also blocked by coupling the propagating undesired wave with the undesired-wave propagation blocking circuit 4.

Figure 1:
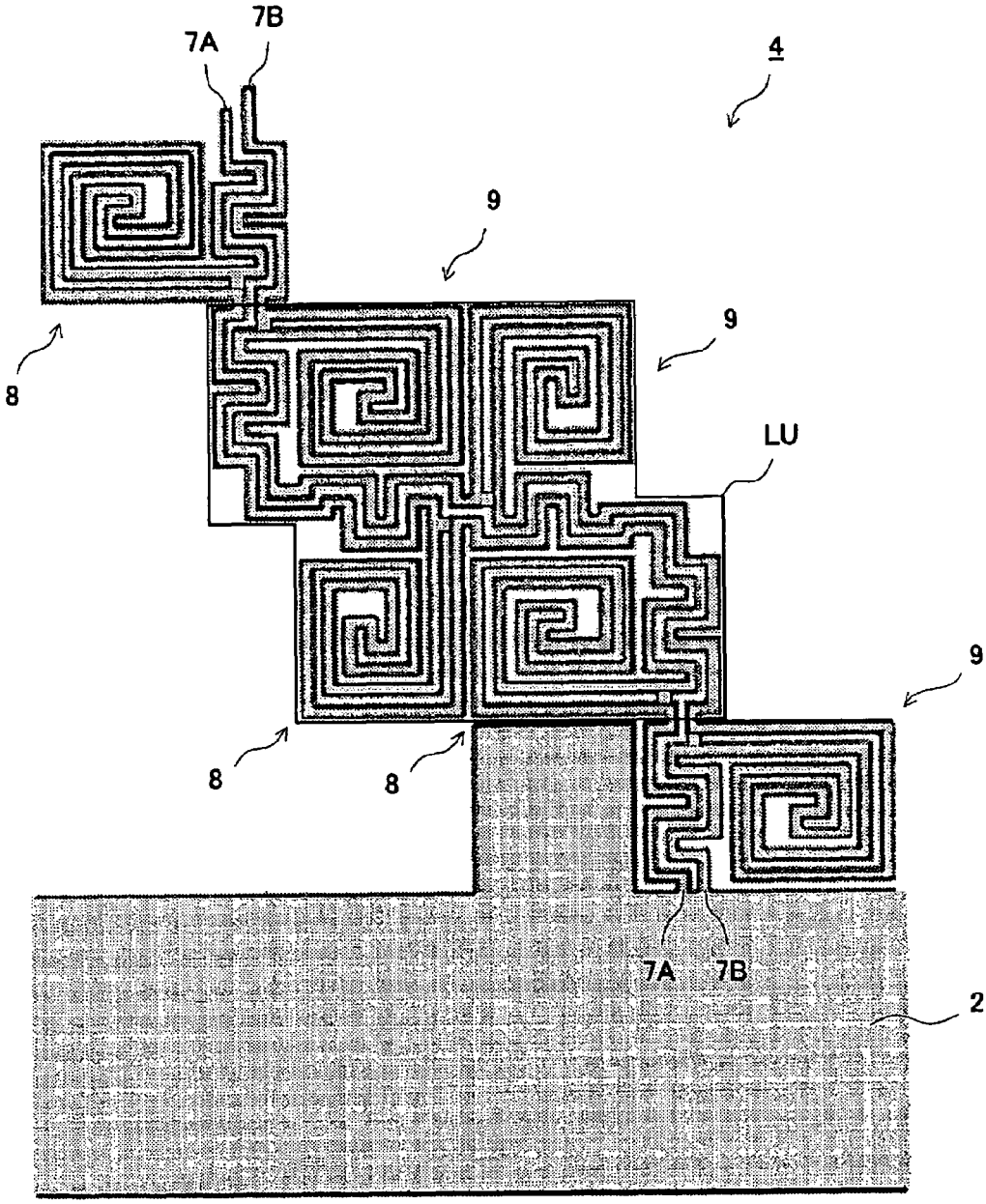
FIG. 1 is a plan view showing the structure of a main portion of an undesired-wave propagation blocking circuit according to a first embodiment.
Figure 2:
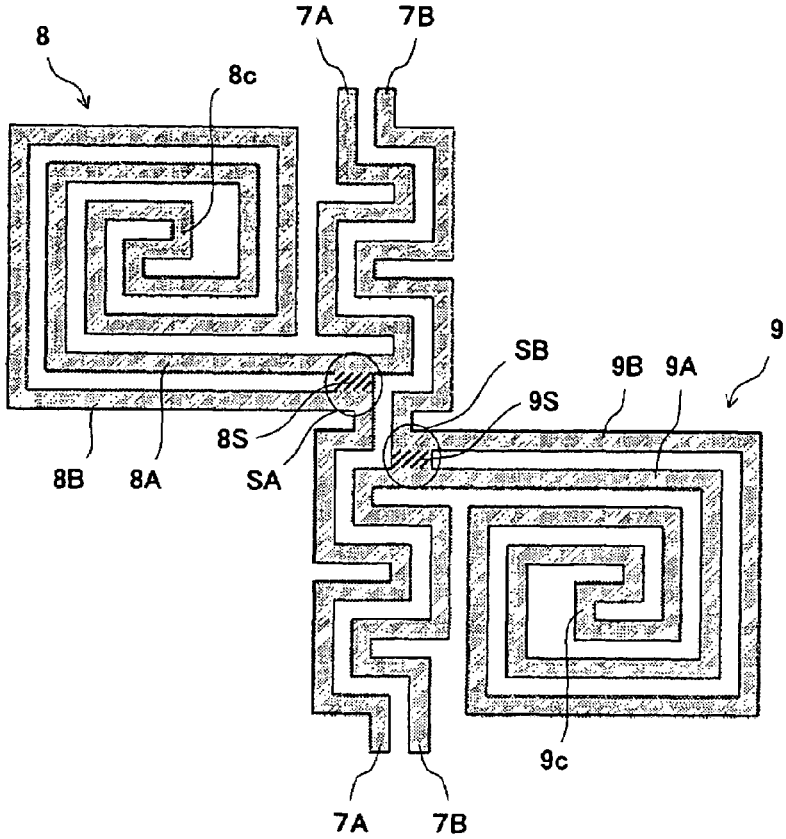
FIG. 2 shows a unit lattice pattern of the undesired-wave propagation blocking circuit.

FIG. 1 is a partial top view of the dielectric substrate 1, and FIG. 2 is a plan view of a main portion of the dielectric substrate 1.

The undesired-wave propagation blocking circuit 4 includes resonators 8 and 9 disposed in a plurality of positions of two transmission lines, transmission lines 7A and 7B, respectively. In other words, spiral lines 8A and 8B extend in parallel to each other in a spiral shape from a predetermined midway position SA of the transmission line 7A, and leading ends of the spiral lines 8A and 8B are connected to each other at a point 8c. Similarly, spiral lines 9A and 9B extend in parallel to each other in a spiral shape from a predetermined midway position SB of the transmission line 7B, and leading ends of the spiral lines 9A and 9B are connected to each other at a point 9c.

The resonators 8 and 9 are hairpin resonators in a spiral shape and are disposed in predetermined rectangular areas. In addition, the resonators 8 and 9 are disposed in midway positions of the transmission lines at intervals of ideally a quarter of the wavelength of the transmission lines 7A and 7B.

Although only a portion in which three resonators 8 and three resonators 9 are connected to the transmission lines 7A and 7B, respectively, is shown in FIG. 1, the undesired-wave propagation blocking circuit 4 is formed by arranging a plurality of resonators such that a predetermined area of each of the upper and lower surfaces of the dielectric substrate is filled with the plurality of resonators. More specifically, a plurality of transmission lines and a plurality of resonators are disposed such that a plane space is filled with as many resonators as possible by arranging, in a matrix, unit lattices LU each including the transmission lines 7A and 7B, the two resonators 8, and the two resonators 9 shown in FIG. 1. As described above, a circuit that includes resonators disposed in a plurality of positions of two transmission lines and that is formed by arranging the resonators such that a predetermined area of a dielectric substrate is filled with the resonators is the undesired-wave propagation blocking circuit 4 shown in FIG. 4.

Figure 3:
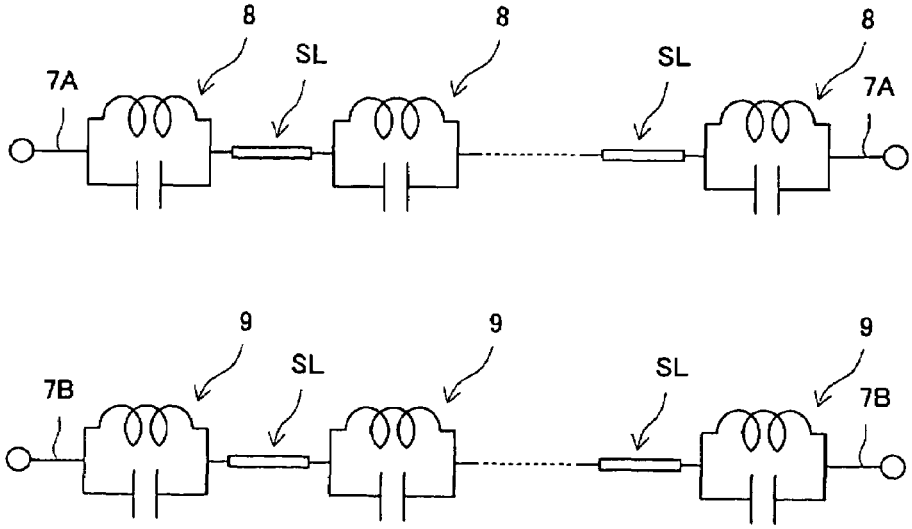
FIG. 3 includes equivalent circuit diagrams of the undesired-wave propagation blocking circuit.

FIG. 3 includes equivalent circuit diagrams of the undesired-wave propagation blocking circuit shown in FIGS. 1 and 2. Here, SL represents the transmission lines 7A and 7B. A portion represented by SL functions as a phase shifter having an input-output phase difference of ninety degrees and existing between adjoining resonators 8 and 8 or between adjoining resonators 9 and 9. Here, the resonators 8 and 9 are represented as LC parallel resonant circuits. Accordingly, band eliminate filters are configured. Thus, the resonators 8 and 9 reflect undesired waves in a frequency band centered on a resonant frequency fo represented by the relationship described below.

$$fo=1/\{2\pi\sqrt{(LC)}\}$$

When an undesired wave is reflected by the undesired-wave propagation blocking circuit, the reflected wave (undesired wave) is recoupled with a transmission mode of the CBCPW. Thus, transmission loss of the CBCPW due to conversion of the transmission mode of the CBCPW into a mode of the undesired wave can be reduced.

Since the space between the spiral lines 8A and 8B is set to one tenth or less of the thickness of the dielectric substrate, the capacitance generated between the spiral lines 8A and 8B is sufficiently large compared with the capacitance generated between the spiral lines 8A and 8B and a conductor on a surface facing the spiral lines 8A and 8B across the dielectric substrate. As a result, the capacitance of the resonator 8 is determined in accordance with the capacitance generated between the spiral lines 8A and 8B. Since a capacitance component between the spiral lines 8A and 8B increases in accordance with a reduction in the space between the spiral lines 8A and 8B, reducing the space between the spiral lines 8A and 8B reduces the size of the resonators 8 and 9 for achieving a necessary resonant frequency fo. In addition, since an inductance component and a capacitance component increase in accordance with an increase in the length of the spiral lines 8A and 8B, a capacitance and an inductance can be increased while suppressing an increase in the sizes of the resonators 8 and 9, compared with a case where a capacitance and an inductance are independently increased as in patent document 1. Thus, when undesired waves at the same frequency are blocked, the sizes of the resonators 8 and 9 can be reduced.

In addition, unlike the undesired-wave propagation blocking circuit described in patent document 2, root portions of the resonators 8 and 9 are short-circuited by providing short-circuit portions 8S and 9S for allowing short circuit between the spiral parallel lines 8A and 8B and between the spiral parallel lines 9A and 9B.

A characteristic of the undesired-wave propagation blocking circuit provided in the high-frequency circuit device according to the first embodiment is described next.

In order to estimate the undesired-wave propagation blocking circuit of the high-frequency circuit device shown in FIG. 4, a transmission characteristic between ports #1 and #2 of the CBCPW is measured.

In FIG. 4, the width W of the dielectric substrate 1 is 7.4 mm, the length L is 9.9 mm, the thickness t is 0.3 mm, and the relative dielectric constant $\epsilon r$ is 24. The length L corresponds to 6.4-wavelength($\lambda g$) at 60 GHz. The distance from the central portion of the central conductor 3U to the undesired-wave propagation blocking circuit 4 is 275 μm. The size of the unit lattice LU is 0.15 mm.

FIGS. 6A and B show measurement results of a transmission characteristic (S21 characteristic) between the ports #1 and #2 of the CBCPW shown in FIG. 4. FIG. 6A shows an effective bandwidth in which propagation of an undesired wave is blocked, representing a frequency on the horizontal axis and representing an attenuation on the vertical axis. In FIG. 6A, (1) represents a characteristic in a case where no undesired wave is generated, and (2) represents a characteristic in a case where an undesired wave is generated and no undesired-wave propagation blocking circuit is provided. In addition, (3) represents a characteristic in a case where an undesired wave is generated and the undesired-wave propagation blocking circuit 4 described in the first embodiment is provided, and (4) represents a characteristic in a case where the short-circuit portions 8S and 9S are not provided (short circuit is not performed) as the undesired-wave propagation blocking circuit.

This example shows characteristics in a case where an undesired-wave propagation blocking circuit is disposed on only one surface of a dielectric substrate and a solidly spread ground electrode is disposed on the other surface of the dielectric substrate.

When the short-circuit portions 8S and 9S are not provided, although the attenuation is reduced at frequencies between 53 GHz and 58 GHz, the bandwidth is narrow, such as about 5 GHz. In contrast, when the short-circuit portions 8S and 9S are provided, the attenuation can be reduced at frequencies between 58 GHZ and 69 GHz, which is centered on 64 GHz, in a wide use frequency band, such as 11 GHz.

It is expected that, as described above, the bandwidth in which propagation of an undesired wave is blocked (reflected) increases when the short-circuit portions 8S and 9S are provided as the undesired-wave propagation blocking circuit compared with a case where the short-circuit portions 8S and 9S are not provided since the degree of combination with the undesired wave increases at a frequency near a resonant frequency of the resonators 8 and 9.

FIG. 6B shows comparison between a case where undesired-wave propagation blocking circuits are disposed on both surfaces of a dielectric substrate and a case where an undesired-wave propagation blocking circuit is disposed on only one surface of the dielectric substrate. In FIG. 6B, (1) represents a characteristic in a case where no undesired wave is generated, (2) represents a characteristic in a case where an undesired wave is generated and no undesired-wave propagation blocking circuit is provided. In addition, (3) represents a characteristic in a case where an undesired-wave propagation blocking circuit is provided on only one surface, and (4) represents a characteristic in a case where undesired-wave propagation blocking circuits are provided on both surfaces of the dielectric substrate.

When undesired-wave propagation blocking circuits are provided on both surfaces of the dielectric substrate, a bandwidth in which the attenuation of the S21 characteristic is small, that is, the leakage as an undesired wave reduces, increases. For example, for an attenuation of −3 dB, although a bandwidth is about 11 GHz, which is between 58 GHz and 69 GHz, as shown by (3), when an undesired-wave propagation blocking circuit is provided on only one surface, a bandwidth increases to about 17 GHz, which is between 53 GHz and 70 GHz, as shown by (4), when undesired-wave propagation blocking circuits are provided on both surfaces.

Figure 7:
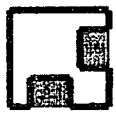
FIG. 7 shows size comparison between the unit lattice pattern of the undesired-wave propagation blocking circuit according to the invention of this application and known unit lattice patterns.
Figure 7:
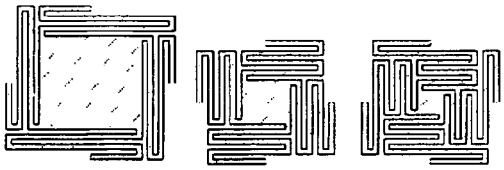
Figure 7:
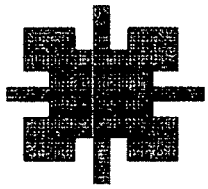

FIG. 7 shows size comparison between a unit lattice of the undesired-wave propagation blocking circuit described in this embodiment and unit lattices of known undesired-wave propagation blocking circuits. Here, part (A) represents a unit lattice pattern of the undesired-wave propagation blocking circuit according to the first embodiment, part (B) represents unit lattice patterns of the undesired-wave propagation blocking circuit in patent document 1, and part (C) represents a unit lattice pattern of the undesired-wave propagation blocking circuit in non-patent document 1. When the unit lattice length of the unit lattice pattern shown in part (C) is 1, although the unit lattice lengths of the unit lattice patterns shown in part (B) are between 0.34 and 0.45, the unit lattice length of the unit lattice pattern shown in part (A) according to the embodiment of the present invention is 0.09. Accordingly, it can be seen that the size of the unit lattice pattern shown in part (A) is extremely reduced. In addition, for parts (C) and (B), the design values of unit lattice lengths (mm) at 30 GHz are 1.12 mm and between 0.38 mm and 0.51 mm, respectively. In contrast, the design value of the unit lattice length at 30 GHz in this embodiment is 0.1 mm, thus enabling to significantly reduce the size.

The configuration of an undesired-wave propagation blocking circuit according to a second embodiment will be described with reference to FIGS. 8A and 8B.

In the example shown in FIG. 1, the line widths of the spiral lines 8A, 8B, 8C, 9A, 9B, and 9C, and the line spaces between the spiral lines 8A and 8B, and between the spiral lines 9A and 9B are constant over the area from the outer periphery of the spiral to the inner periphery of the spiral. However, as shown in FIG. 8A, the line widths of the spiral lines 8A and 8B at a central portion of the spiral may be larger than the line widths of the spiral lines 8A and 8B at the outer periphery of the spiral. The structure of a transmission line portion other than the resonator is similar to that in the first embodiment.

In this case, the current concentration in the spiral lines 8A and 8B is relieved at the central portion of the spiral, which exhibits a high magnetic field strength. Thus, the nonloaded Q (Qo) of the resonator 8 can be improved.

Figure 8:
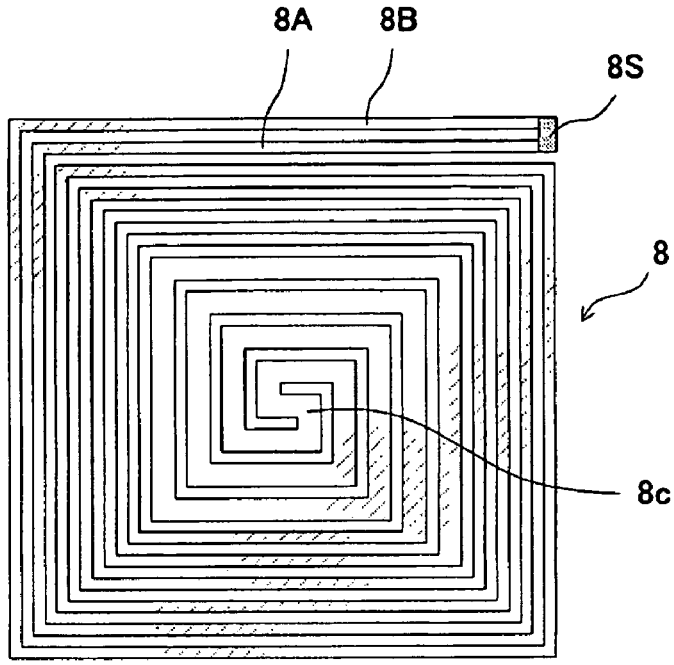
FIGS. 8A and B are plan views showing the structure of a resonator of an undesired-wave propagation blocking circuit according to a second embodiment.
Figure 8:
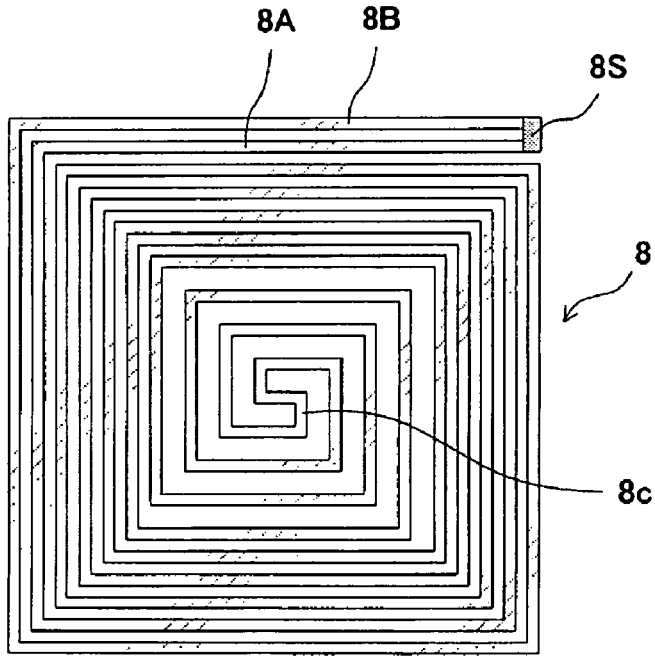

In addition, as shown in FIG. 8B, the space between the two spiral lines 8A and 8B at the central portion of the spiral may be larger than the space between the spiral lines 8A and 8B at the outer periphery of the spiral. In this case, at the central portion of the spiral, the magnetic flux density of a magnetic flux passing through between the lines is reduced, and loss due to power propagating between the lines is reduced. Thus, the nonloaded Q (Qo) of the resonator 8 can be improved.

The structure of an undesired-wave propagation blocking circuit according to a third embodiment will be described with reference to FIG. 9.

Figure 9:
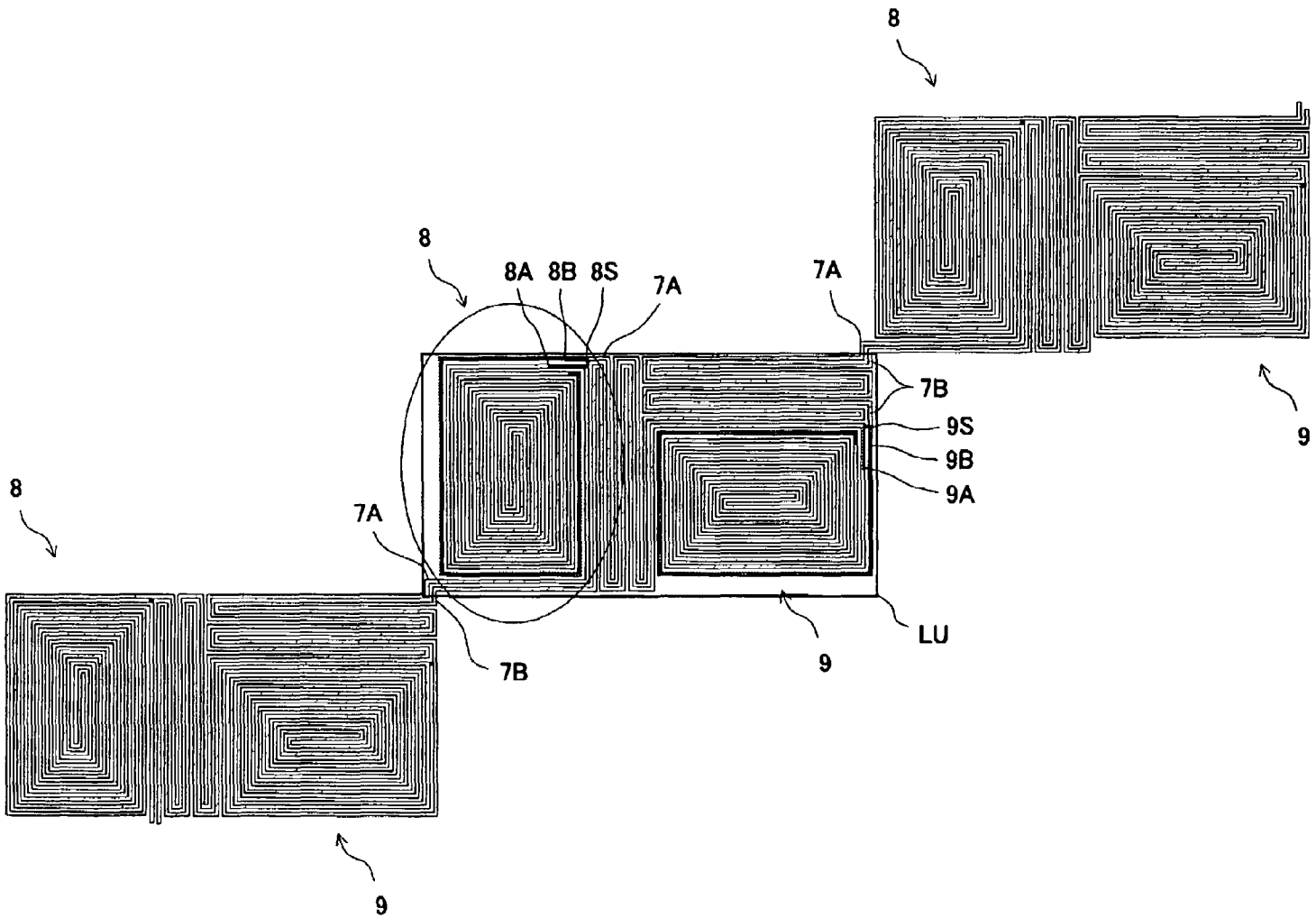
FIG. 9 is a plan view showing the structure of a main portion of an undesired-wave propagation blocking circuit according to a third embodiment.

FIG. 9 is a plan view showing a main portion of the undesired-wave propagation blocking circuit. Similarly to the undesired-wave propagation blocking circuit shown in FIG. 2, the two types of resonators, 8 and 9 are disposed in a plurality of midway positions of the two transmission lines 7A and 7B. The two types of resonators 8 and 9 are rectangular and are mirror-symmetrical to each other. In addition, the resonators 8 and 9 are disposed in a relationship rotated ninety degrees on the plane. In addition, connections between the resonators of the two transmission lines 7A and 7B operate as 90-degree phase shifters, and the connections between the resonators are patterned into a meander line shape. The transmission lines 7A and 7B and the two resonators 8 and 9 form a unit lattice pattern LU. The unit lattice patterns LU are spread over the dielectric substrate by repeating a plurality of unit lattice patterns LU.

The structure of the resonators 8 and 9 is such that the short-circuit portion 8S is provided at a position extending from the transmission line 7A of the spiral lines 8A and 8B, as in the case of the first embodiment. In addition, the short-circuit portion 9S is provided at a position extending from the transmission line 7B of the spiral lines 9A and 9B.

Figure 10:
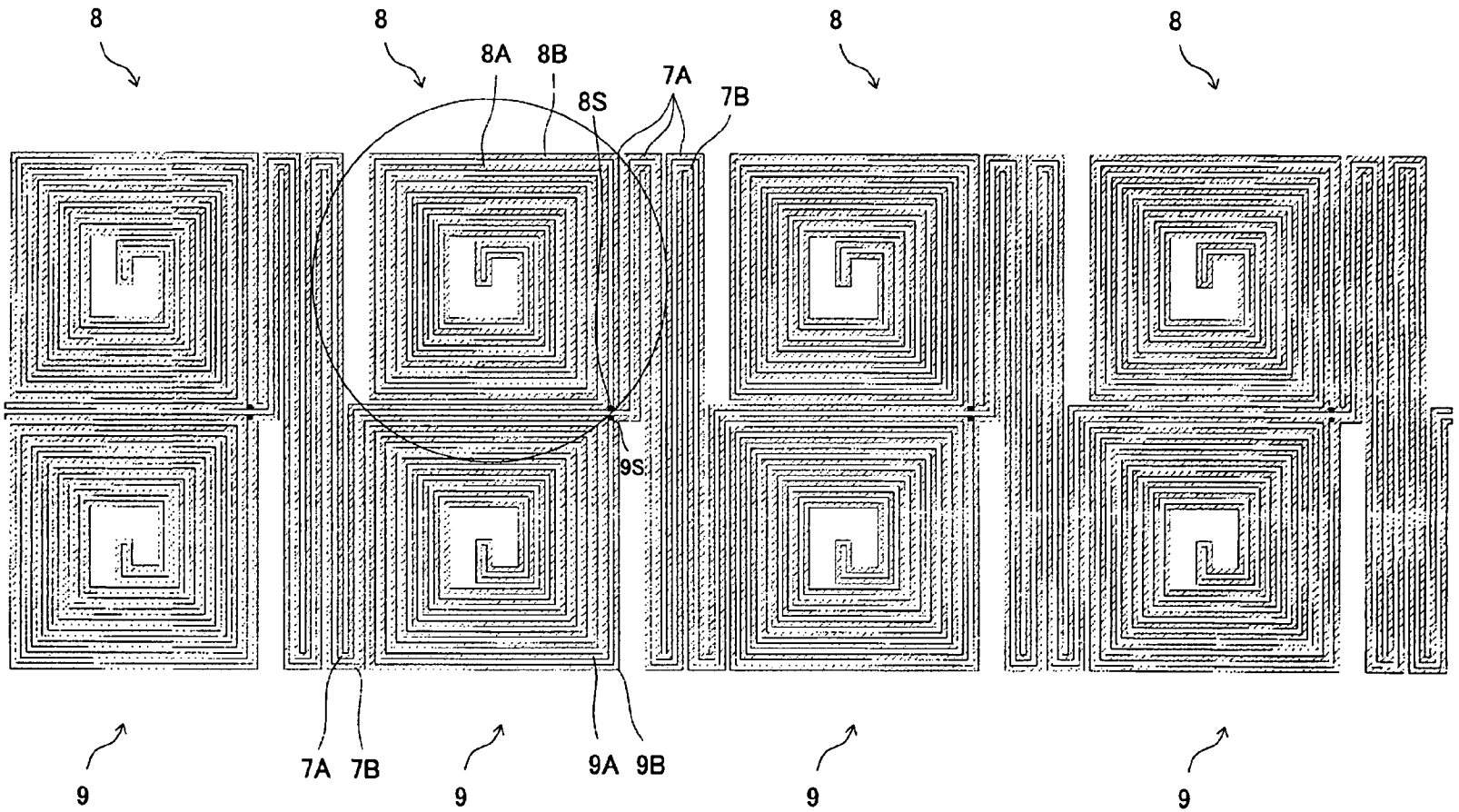
FIG. 10 is a plan view showing the structure of a main portion of an undesired-wave propagation blocking circuit according to a fourth embodiment.

The structure of an undesired-wave propagation blocking circuit according to a fourth embodiment will be described with reference to FIG. 10. In this example, the transmission lines 7A and 7B are patterned into a meander line shape such that the plurality of resonators 8 connected to predetermined positions of one of the two transmission lines, the transmission line 7A, and the plurality of resonators 9 connected to predetermined position of the other one of the two transmission lines, the transmission line 7B, are disposed in lines and in parallel to each other.

With this structure, many unit lattices can be disposed effectively in a limited area. Thus, the undesired-wave propagation blocking circuit can be configured in a planar conductor portion having an extremely small area.

A high-frequency circuit device according to a fifth embodiment and a transmitting and receiving apparatus including the high-frequency circuit device will be described with reference to FIGS. 11 and 12.

Figure 11:
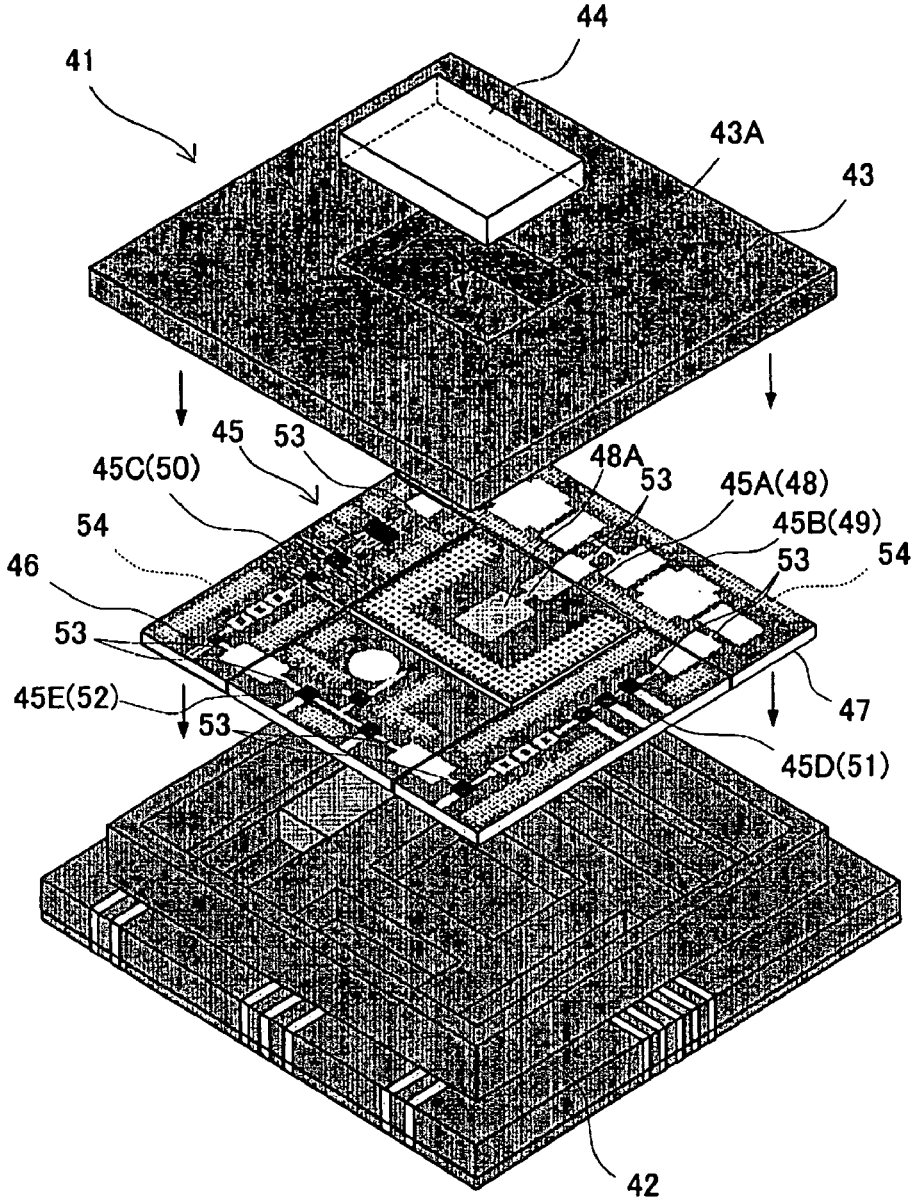
FIG. 11 is an exploded perspective view of a transmitting and receiving apparatus according to a fifth embodiment.
Figure 12:
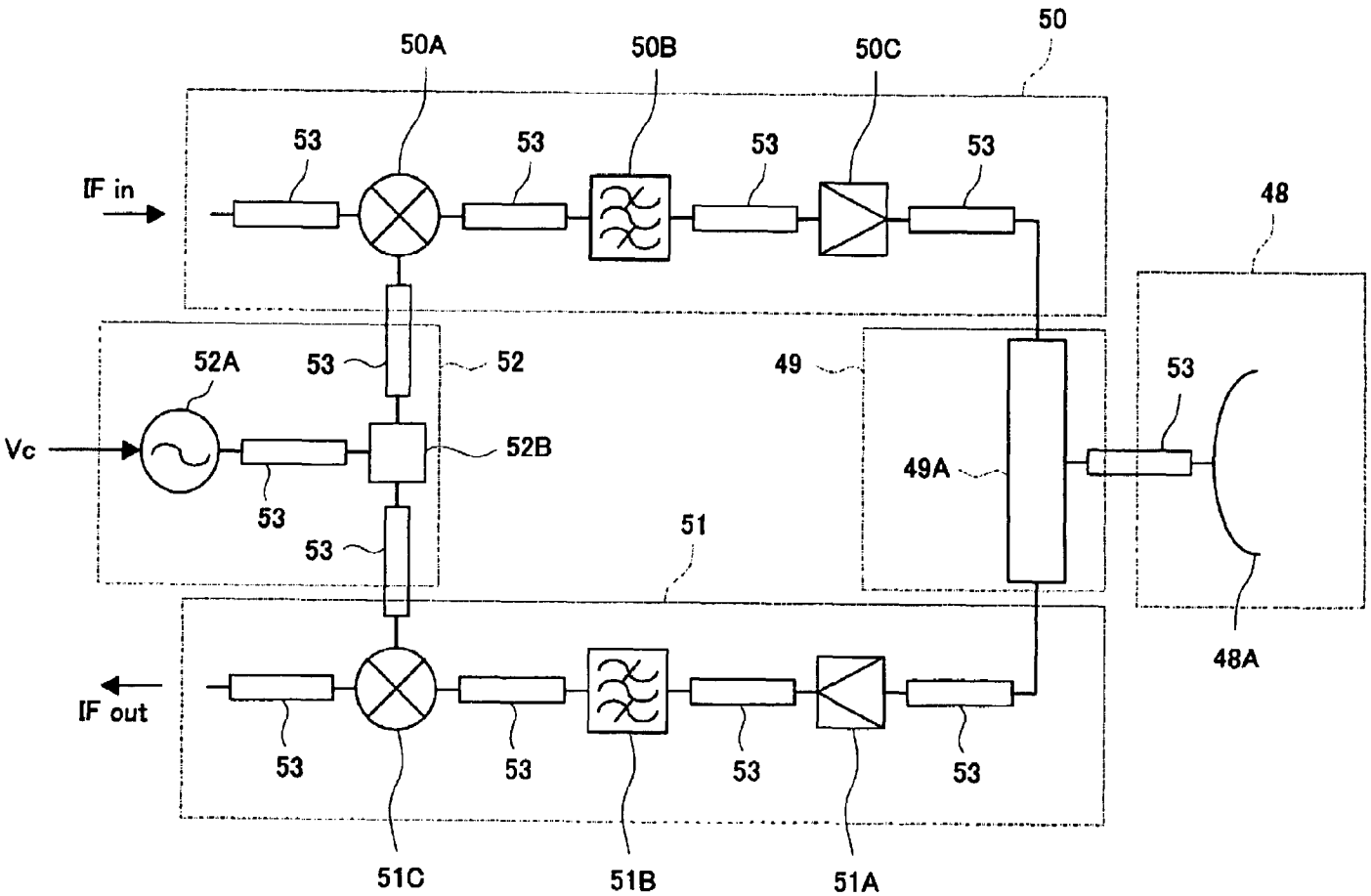
FIG. 12 is a block diagram showing the entire structure of the transmitting and receiving apparatus.
Figure 13:
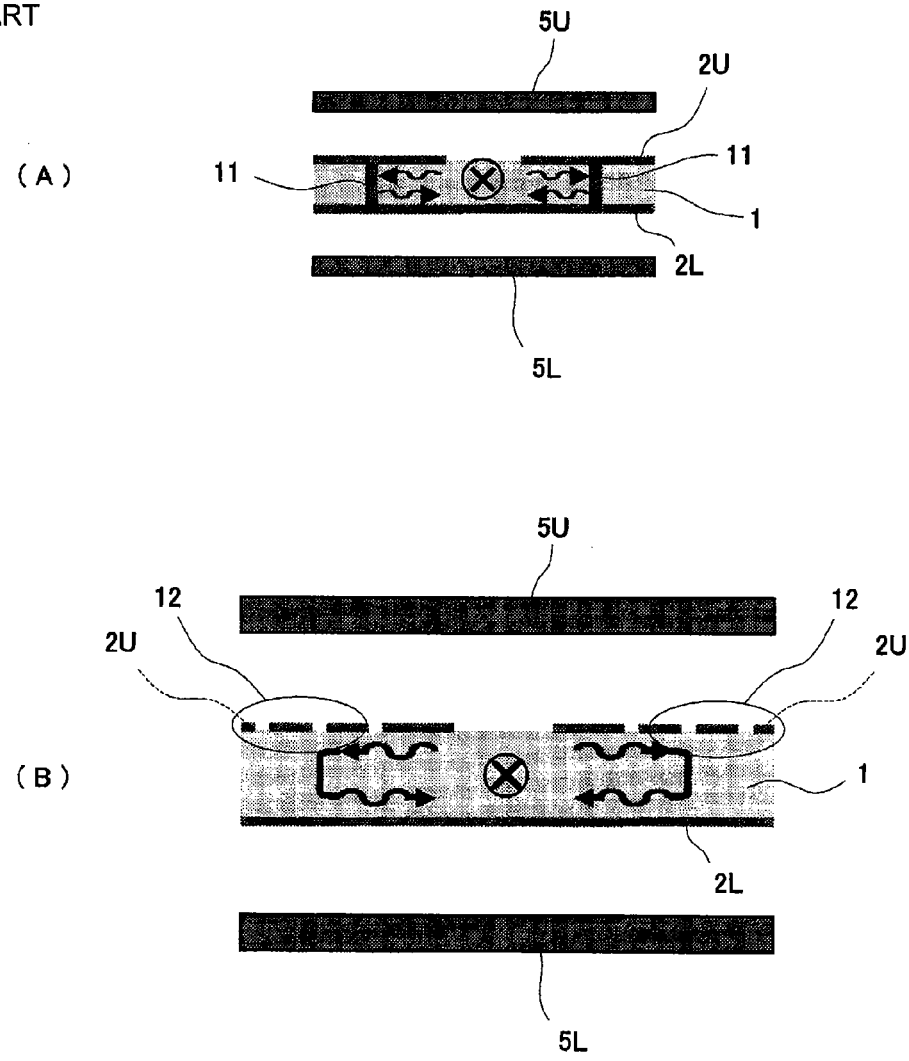
FIG. 13 PRIOR ART
FIGS. 13A and B are cross-sectional views showing the structure of a known undesired-wave propagation blocking circuit.
Figure 14:
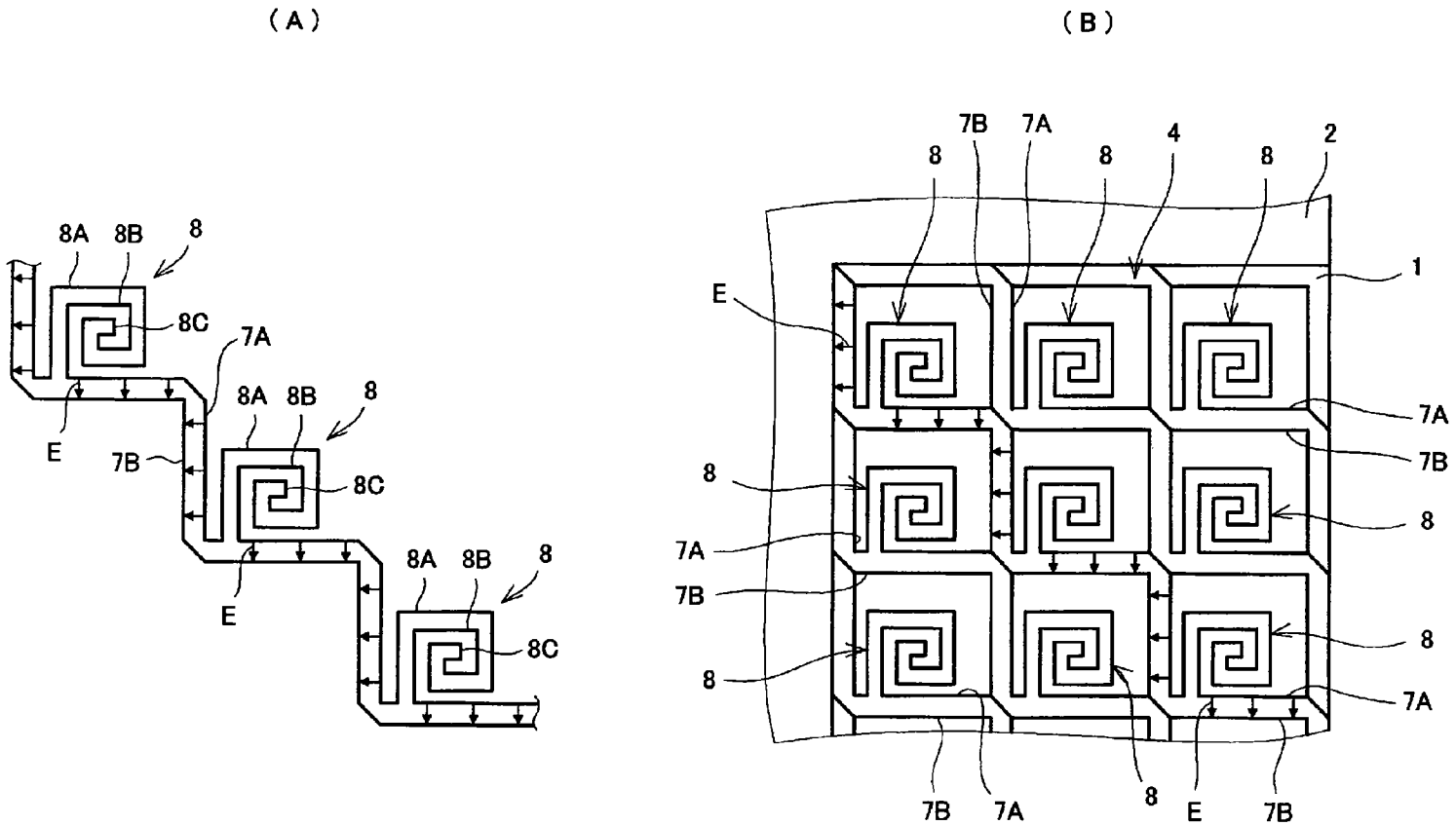
FIG. 14 PRIOR ART
FIGS. 14A and B are plan views of a main portion of the known undesired-wave propagation blocking circuit.

FIG. 11 is an exploded perspective view of the transmitting and receiving apparatus, and FIG. 12 is a block diagram of the circuit. In FIG. 11, a resin package 41 forming the appearance of a communication apparatus includes a box-shaped casing 42 whose upper surface is open and a substantially square plate-shaped cover 43 covering the open side of the casing 42. In addition, a substantially square opening 43A is arranged at the central portion of the cover 43, and a blocking plate 44 through which an electromagnetic wave can transmit is provided in the opening 43.

A dielectric substrate 45 accommodated within the casing 42 includes, for example, five split substrates, split substrates 45A to 45E. Both faces of the split substrates 45A to 45E are covered with planar conductors 46 and 47. As functional blocks, an antenna block 48, a duplexer block 49, a transmission block 50, a reception block 51, and an oscillator block 52, which will be described below, are provided on the split substrates 45A to 45E, respectively.

The antenna block 48, which transmits a transmission electric wave and receives a reception electric wave, is provided on the split substrate 45A located on the central portion side of the dielectric substrate 45, and includes a radiating slot 48A, which forms a quadrilateral opening arranged in the planar conductor 46. In addition, the radiating slot 48A is connected to the duplexer block 49 via a transmission line 53 formed by a PDTL.

The duplexer block 49, which forms an antenna duplexer, includes a resonator 49A forming a quadrilateral opening arranged in the planar conductor 46 on the split substrate 45B and the like. The resonator 49A is connected to the antenna block 48, the transmission block 50, and the reception block 51 via the transmission lines 53 formed by PDTLs.

The transmission block 50, which outputs a transmission signal to the antenna block 48, includes electronic components, such as a field effect transistor, mounted on the split substrate 45C. The transmission block 50 includes a mixer 50A mixing an intermediate frequency signal IF with a carrier output from the oscillator block 52 to up-convert the mixture into a transmission signal, a band pass filter 50B eliminating noise from the transmission signal acquired from the mixer 50A, and a power amplifier 50C amplifying power of the transmission signal.

The mixer 50A, the band pass filter 50B, and the power amplifier 50C are connected to each other using the transmission lines 53 formed by PDTLs. In addition, the mixer 50A is connected to the oscillator block 52 via the transmission line 53, and the power amplifier 50C is connected to the duplexer block 49 via the transmission line 53.

The reception block 51 is provided on the split substrate 45D. The reception block 51 receives a reception signal received by the antenna block 48, and mixes the reception signal with a carrier output from the oscillator block 52 to down-convert the mixture into an intermediate frequency signal IF. The reception block 51 includes a low-noise amplifier 51A amplifying the reception signal with low noise, a band pass filter 51B eliminating noise from the reception signal acquired from the low-noise amplifier 51A, and a mixer 51C mixing a carrier output from the oscillator block 52 with the reception signal output from the band pass filter 51B to down-convert the mixture into an intermediate frequency signal IF.

The low-noise amplifier 51A, the band pass filter 51B, and the mixer 51C are connected to each other using the transmission lines 53. The low-noise amplifier 51A is connected to the duplexer block 49 via the transmission line 53, and the mixture 51C is connected to the oscillator block 52 via the transmission line 53.

The oscillator block 52 is provided on the split substrate 45E, and oscillates a signal at a predetermined frequency (for example, a high-frequency signal, such as a microwave or a millimeter wave) serving as a carrier. The oscillator block 52 includes a voltage controlled oscillator 52A oscillating a signal at a frequency corresponding to a control signal Vc and a branch circuit 52B for supplying to the transmission block 50 and the reception block 51 a signal from the voltage controlled oscillator 52A.

The voltage controlled oscillator 52A and the branch circuit 52B are connected to each other using the transmission line 53 formed by a PDTL. In addition, the branch circuit 52B is connected to the transmission block 50 and the reception block 51 via the transmission lines 53.

In FIG. 11, undesired-wave propagation blocking circuits 54 are disposed in positions represented by two-dot chain lines on the front surface of the split substrates 45A to 45E. Each of the undesired-wave propagation blocking circuits 54 is an undesired-wave propagation blocking circuit described in any of the first to fourth embodiments. In this example, the undesired-wave propagation blocking circuits are disposed near the radiating slot 48A, the resonator 49A, the band pass filter 50B, the band pass filter 51B, the voltage controlled oscillator 52A, the transmission lines 53, and the like.

Since the undesired-wave propagation blocking circuits 54 are disposed on the split substrates 45A to 45E, undesired waves propagating between the planar conductors 46 and 47 of the dielectric substrate 45 can be blocked. Thus, for example, coupling of undesired waves in a parallel-plate mode or the like between the split substrates 45A to 45E is prevented, and the isolation is improved. In addition, power loss due to undesired waves is reduced, and high efficiency is achieved. Moreover, noise due to undesired waves can be reduced.

Although each of the resonators 8 and 9 is substantially rectangular in a spiral shape in each of the foregoing embodiments, the present invention is not limited to this. The resonators may be, for example, circular or oval in a spiral shape.

In addition, although an undesired-wave propagation blocking circuit is formed by the plurality of resonators 8 and 9 having the same resonant frequency in each of the foregoing embodiments, the present invention is not limited to this. For example, an undesired-wave propagation blocking circuit may be formed using a plurality of resonators having different resonant frequencies. Thus, a blocking bandwidth of an undesired-wave propagation blocking circuit can be further increased.

In addition, although a grounded coplanar line (CBCPW) is explained as an example in FIG. 4, as another circuit that excites an electromagnetic wave between planar conductors, another type of transmission line, such as a grounded slot line, a coplanar line, or a PDTL, may be used. In addition, a semiconductor element, such as an FET, or an individual element, such as a resonator or a filter, may be used.

In addition, although the present invention is applied to a high-frequency circuit device including two planar conductors 2 in each of the foregoing embodiments, the present invention is also applicable to, for example, a high-frequency circuit device including three or more planar conductors.

Moreover, although a communication apparatus is explained as a transmitting and receiving apparatus in the fifth embodiment, the present invention is not limited to this. For example, the present invention is widely applicable to a transmitting and receiving apparatus, such as a radar apparatus.

The invention claimed is:

1. A high-frequency circuit device comprising:

at least two parallel planar conductors; and an undesired-wave propagation blocking circuit that is coupled with an undesired wave propagating between the two planar conductors to block the propagation of the undesired wave, wherein the undesired-wave propagation blocking circuit forms a band eliminate filter including a plurality of stages of resonators and transmission lines each connecting the resonators in the respective stages, the transmission lines are two transmission lines that are parallel to each other, each resonator in the respective stages has two spiral lines extending in parallel to each other from a root portion thereof, leading ends of the two spiral lines are connected to each other, each root portion of each resonator is connected to at least one of the two transmission lines at a plurality of locations, and each resonator is short-circuited at the root portion.

2. The high-frequency circuit device according to claim 1, wherein the plurality of resonators is connected to the corresponding transmission lines at an interval of (2n+1)/4 of the wavelength of the transmission lines, wherein n is an integer of 0 or more.

3. A transmitting and receiving apparatus, comprising:

a signal propagation section or a signal processing section; and a high-frequency circuit device as set forth in claim 1.

4. A transmitting and receiving apparatus, comprising:

a signal propagation section or a signal processing section; and a high-frequency circuit device as set forth in claim 2.

* * * * *